United States Patent [19]

Dal Busco

[11] Patent Number: 4,975,893

[45] Date of Patent: Dec. 4, 1990

[54] WATCH WITH A METAL ROTATING RIM

[75] Inventor: Giancarlo Dal Busco, Courrendlin, Switzerland

[73] Assignee: Remy Montavon S.A., Switzerland

[21] Appl. No.: 435,718

[22] Filed: Nov. 13, 1989

[30] Foreign Application Priority Data

Nov. 25, 1988 [CH] Switzerland ..... 4392/88

[51] Int. Cl.[5] ..... G04B 37/00

[52] U.S. Cl. ..... 368/294; 368/295

[58] Field of Search ..... 368/294–296, 368/21, 22, 27, 223, 233

[56] References Cited

U.S. PATENT DOCUMENTS 4,815,053 3/1989 Dal Busco ..... 368/294

FOREIGN PATENT DOCUMENTS 2440569 7/1980 France ..... 368/10

0665522 5/1988 Switzerland ..... 368/281

*Primary Examiner*—Bernard Roskoski

[57] ABSTRACT

The rotating metal rim (19) is equipped with a toothed ring made of synthetic material (23) catch-fastened to the rotatating rim and catch-mounted on the frame (1) or by means of a band. The toothing of the ring (23) cooperates with at least one pawl (9) mounted in a recess of the frame and held in place on the one hand by a foot (11) and on the other hand by the rotating rim itself. The mounting of the unit and the after-sales service are facilitated.

10 Claims, 1 Drawing Sheet

WATCH WITH A METAL ROTATING RIM

FIELD OF THE INVENTION

The subject of the present invention is a watch with a metal rotating rim in which the rotating rim is equipped with an inner ring made of synthetic material sliding on the frame of the watch and comprising at least one stationary second piece made of synthetic material, one of the two pieces made of synthetic material, the ring or the second piece, being equipped with a toothing and the other piece with at least one pawl cooperating with the toothing for the positioning of the rotating rim.

PRIOR ART

A watch having such a construction is described in the U.S. Pat. No. 4,815,053 issued Mar. 21, 1989. The inner ring made of synthetic material and equipped with a toothing has an L-shaped profile and it is glued into a cylindrical housing of the metal rim. The pawls are integral with a pawl-carrying band which is fastened on to a cylindrical bearing surface of the frame, around the stationary rim, by means of a metal tensioning band. This band also serves for the axial retention of the rotating of the rotating rim by its ring made of synthetic material. With this construction, the pawl-carrying band must be assembled with the rotating rim before mounting this pawl-carrying band on the watchcase. Conversely, if one of the components of the rotating rim is to be removed, it is the unit with the pawl-carrying band which must be removed. If one of the pieces of the unit happens to break, it is the unit which is replaced. In all cases, the replacement of the toothed ring cannot be made without also replacing the metal rim.

The subject of the present invention is a different design. Its object is to enable the pawl-carrying band, and then the rotating rim, to be mounted successively and without a special tool on the frame. In addition, the synthetic part of the rotating rim must be able to be replaced easily.

SUMMARY OF THE INVENTION

The watch with a rotating rim according to the invention has the inner ring made of synthetic material catch-fastened to the rotating rim and the other piece made of synthetic material held in place on the one hand by at least one foot engaged in a hole provided in the frame and on the other hand by the rotating rim.

The inner ring is therefore fastened without gluing to the rotating rim, which enables it to be removed in the event of malfunction and it to be replaced by a new piece. The assembly is very simple: the pawl-carrying band is positioned first, the feet of which are introduced into the holes provided for this purpose in the frame, and the rotating rim with its ring made of synthetic material is then fitted. The rotating rim may be retained axially, either directly by its synthetic ring having a suitable profile for this purpose, or by a split assembly band. In both cases, it is the rotating rim which retains the pawl-carrying band axially.

If repair is necessary, it is possible to remove the rotating rim without removing the pawl-carrying band or the individual pawls. This pawl-carrying band, or one or other of the individual pawls respectively, may be removed and replaced without a special tool. The functions may be reversed, in other words the rotating rim may be equipped with a pawl-carrying band, whereas a toothed ring equipped with feet is retained in rotation on the frame. The after-sales service is therefore greatly simplified. It is, in addition, important to be able to change the toothed ring and/or the pawls without changing the metal rotating rim which is a piece which is substantially more expensive than the pieces made of synthetic material.

In addition to these advantages, the watch according to the invention also has the advantages of the prior method of production, namely the possibility of employing any material for the rotating rim and the case whilst having an easy rotation of this rotating rim on the case, regularity of the friction, total absence of corrosion in the region of the catch engagement, precision of the catching and the physical resistance of the latter.

BRIEF DESCRIPTION OF THE DRAWINGS

The attached drawings shows, by way of example, some embodiments of the watch according to the invention.

DESCRIPTION OF THE PREFERRED EMBODIMENT

Figure 1:
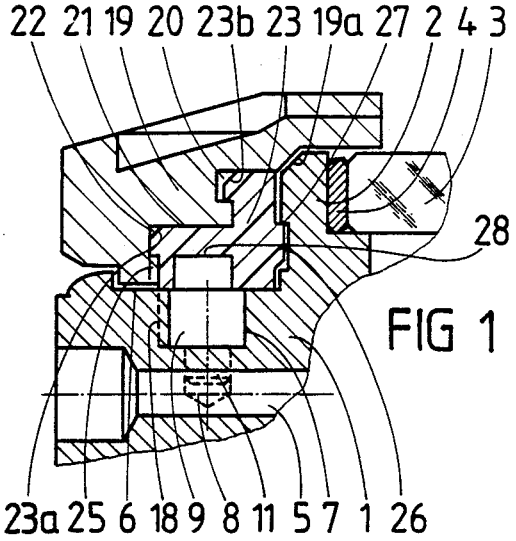
FIG. 1 is a partial view of axial cross-section of a watchcase according to a first embodiment.
Figure 2:
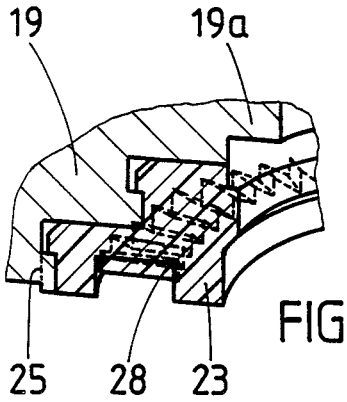
FIG. 2 is a similar cross-section showing the rotating rim alone.
Figure 3:
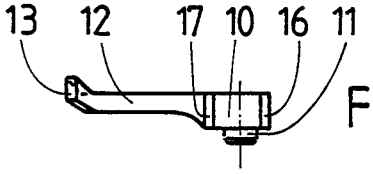
FIG. 3 is a view in elevation of a pawl.
Figure 4:
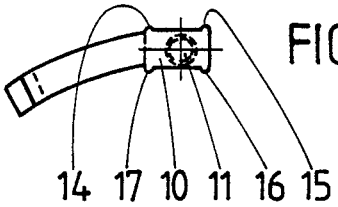
FIG. 4 is a plane view of this same pawl.

The watch with a rotating rim shown in FIG. 1 comprises a frame 1 having a rim 2 in which is fastened a piece of glass 3 by means of a lining 4. The passage 5 for the time-setting pin has also been shown. Around the stationary rim 2, the frame 1 has a plane bearing surface 6 in which are provided three equidistant recesses 7 in the arc of a circle. Near one of the ends of these recesses 7, the bottom of the recess has a blind hole 8. A pawl 9, such as shown in FIGS. 3 and 4, is housed in each of the recesses 7. Each of these pawls 9 made of synthetic material has a base 10 of a rectangular general shape and equipped with a cylindrical foot 11 which is housed freely in the blind hole 8 of the frame. An elastic arm 12, which ends in a pawl hook 13, extends from the base 10. The elastic arm 12 is, of course, thinner than the base 10 such that, by flexing the arm 12, the pawl hook 13 can be withdrawn entirely into the recess 7. So as to ensure a better circumferential strength of the pawl, the base 10 is equipped with vertical flanges 14, 15, 16 and 17 at its corners. These flanges engage in vertical recesses such as 18 provided in the walls of the recess 7.

The watch is equipped with a rotating metal rim 19 having a bearing surface **19*a* which covers the stationary rim 2. Below the bearing surface 19*a*, the rotating rim 19 has an annular radial recess 20 and, below this recess 20, a plane bearing surface 21 which extends up to a second annular radial recess 22. The recesses 20 and 22 form two catches in which a ring made of synthetic material 23 having a profile corresponding to the inner profile of the rotating metal rim 19 is catch-fastened. In the region of the two catches, the periphery of the synthetic ring 23 has two bevels 23***a* and 23*b* enabling the ring 23 to be fastened by pressure alone. The ring 23 is, in addition, locked in rotation by at least one boss which engages in a recess 25 of the rotating metal rim 19. The bosses of the ring 23 may have the shape of the boss which appears in FIG. 6. The ring made of synthetic material 23 has on its inside an annular projection 26 by which it is retained axially on a catch 27 of the frame 1. The ring 23 has a wolf teeth toothing 28 cooperating axially with the pawls 9. In this case, the rotating rim 19 can therefore only rotate in one direction. It would, however, be possible to form a toothing such that the rotating rim can rotate in both directions.

In order to mount this rotating rim, the pawls 9 are fitted first, and then the rotating rim 19, equipped with its ring 23, is fastened by pressure alone. The bevels provided on the outer edge of the stationary rim 2 and at the base of the projection 26 and the elasticity of the synthetic material of the ring 23 enable this mounting to be carried out easily.

Figure 5:
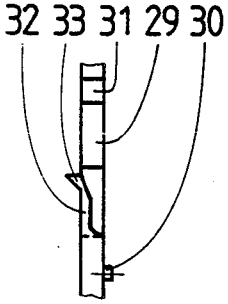
FIG. 5 is a partcal view in elevation of a pawl-carrying band.
Figure 6:
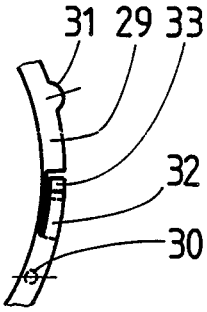
FIG. 6 is a plane view of the this same portion of pawl-carrying band.

Instead of segmented pawls, it is possible to employ a band equipped with one or more pawls, such as shown in FIGS. 5 and 6. This band 29 made of synthetic material is also equipped with a cylindrical foot 30 and with a lateral boss 31. The band 29 is equipped with one or more pawls 32 having a pawl hook 33 projecting above the band. In this case, the recess 7 provided in the frame 1 extends over the entire periphery of this frame in order to accommodate the band 29. The foot 30 of the ring 29 is housed in a hole identical to the hole 8. As for the boss 31, it is housed in a recess similar to the recess 25 for fastening the band 29 in rotation.

Figure 7:
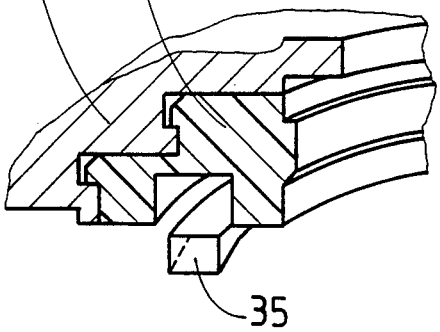
FIG. 7 is a cross-sectional view of a rotating rim equipped with a pawl-carrying band.

It is possible to reverse the position of the toothing and pawl functions. FIG. 7 shows, by way of example, the same rim 19 equipped with a ring 34 made of synthetic material in which at least one pawl 35 is formed, intended to cooperate with a toothed ring housed in the positionk of the pawl-carrying band 29. The ring 34 is otherwise identical to the ring 23.

Figure 8:
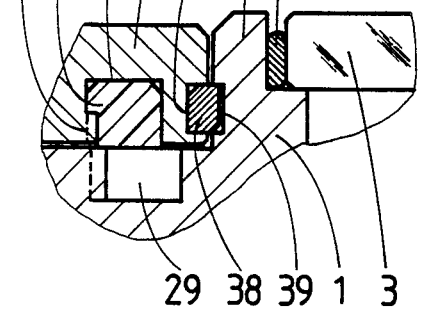
FIG. 8 is a partial view in axial cross-section of another embodiment.

By preserving most of the advantages of the first embodiment, it is possible to mount the rotating rim on the frame by means of an auxiliary band. FIG. 8 shows an exemplary embodiment. The frame 1 is the same as that in the first embodiment. However, the metal rotating rim 36 is lower than the rim 19 and it is equipped with a recess 37 on its inside. Assembly is performed by means of a split metal band 38 with a rectangular profile and equipped with two diagonally opposite bevels. The split band is first fastened in a recess 39 of the frame 1 with a degree of radial clearance. The rim 36 is then engaged with pressure onto the assembly band 38. The latter is at first completely withdrawn into the recess 39 and then expands into the recess 37 of the rotating rim. This method of fastening is well known. The rotating rim 36 is equipped with a toothed ring 40 which is substantially smaller than in the first embodiment, but is also catch-fastened in a groove 41. This ring 40 is also locked in rotation by at least one boss engaged in a recess 42 of the rotating rim. The toothed ring 40 works with a pawl-carrying band 29 as shown in FIGS. 5 and 6.

The mounting could also be effected by means of a band which is not split.

I claim:

1. A watch having a frame (1), a metal rotating rim (19;36) equipped with an inner ring made of synthetic material (23;34;40) sliding on the frame (1) of the watch and further comprising at least one stationary member made of synthetic material (9;29), one of said ring and member being equipped with a toothing and the other of said ring and member being equipped with at least one pawl cooperating with the toothing for the positioning of the rotating rim, wherein the inner ring is catch-fastened to the rotating rim and said member is held in place on the one hand by at least one foot. (11;30) engaged in a hole (8) provided in the frame and on the other hand by the rotating rim.

2. A watch as claimed in claim 1, wherein the toothing ring (28) is on the ring.

3. A watch as claimed in claim 2, which comprises several independent members having pawls (9) each equipped with a foot (11).

4. A watch as claimed in claim 2, wherein said member comprises a band (29) equipped with a plurality of pawls and with at least one foot (30).

5. A watch as claimed in claim 1, wherein the toothing is on said member, and wherein the ring (34) is equipped with said at least one pawl.

6. A watch as claimed in claim 1, wherein the rotating rim is retained axially on the frame by its ring (23;34).

7. A watch as claimed in claim 1, wherein the rotating rim (36) is retained axially on the frame by a band (38), split or otherwise, engaged in a recess of the frame and a recess of the rotating rim.

8. A watch as claimed in claim 1, wherein the ring is equipped with at least one lateral boss engaged in a recess (25) of the rotating rim for fastening the ring in rotation.

9. A watch as claimed in claim 4 wherein the band is equipped with at least one lateral boss (31) engaged in a recess of the frame for fastening the band in rotation.

10. A watch as claimed in claim 3 wherein the several independent members having pawls are each equipped with at least one lateral boss (14 to 17) engaged in a recess of the frame for fastening the independent member in rotation.

* * * * *